US005481346A

United States Patent [19]

Ohzeki et al.

[11] Patent Number: 5,481,346

[45] Date of Patent: Jan. 2, 1996

[54] IMAGE FORMING APPARATUS CAPABLE OF ADJUSTING FIXING CONDITIONS

[75] Inventors: Yukihiro Ohzeki, Tokyo; Yasushi Sato, Kawasaki, both of Japan

[73] Assignee: Canon Kabushiki Kaisha, Tokyo, Japan

[21] Appl. No.: 232,350

[22] Filed: Apr. 22, 1994

Related U.S. Application Data

[63] Continuation of Ser. No. 913,386, Jul. 15, 1992, abandoned.

[30] Foreign Application Priority Data

Jul. 17, 1991 [JP] Japan ..... 3-176797

[51] Int. Cl.[6] ..... G03G 15/20

[52] U.S. Cl. ..... 355/285

[58] Field of Search ..... 355/208, 282, 355/285, 286, 289, 290, 295

[56] References Cited

U.S. PATENT DOCUMENTS

| | | | |
|---|---|---|---|
| 4,652,110 | 3/1987 | Sato et al. | 355/282 X |
| 4,671,643 | 6/1987 | Shigemura et al. | 355/282 |
| 4,825,242 | 4/1989 | Elter | 355/285 X |
| 4,878,092 | 10/1989 | Arai | 355/285 |
| 4,933,724 | 6/1990 | Sugimoto et al. | 355/289 |
| 4,937,600 | 6/1990 | Hirabayashi et al. | 346/160.1 |

FOREIGN PATENT DOCUMENTS

| | | | |
|---|---|---|---|
| 1-195483 | 8/1989 | Japan | 355/282 |
| 2-29770 | 1/1990 | Japan | 355/282 |
| 2-298980 | 12/1990 | Japan | 355/282 |
| 3-249769 | 11/1991 | Japan | 355/282 |

*Primary Examiner*—Fred L. Braun

*Attorney, Agent, or Firm*—Fitzpatrick, Cella, Harper & Scinto

[57] ABSTRACT

An image forming apparatus which maintains proper fixing conditions through various situations. The apparatus includes a device for forming an unfixed image on a recording material; a fixing device for thermally fixing the unfixed image of the recording material; and a setting device for setting the fixing condition of the fixing device based on the number of image forming operations and the output of a temperature detecting element, which monitors the temperature of the heater in the fixing device.

17 Claims, 11 Drawing Sheets

ROM 1

| | TARGET TEMP | | SPECULATIVE START TEMP | |
|---|---|---|---|---|
| | TL | TH | TSL | TSH |
| B4 | 180°C | 180°C | 160°C | 160°C |
| A4 | 180°C | 190°C | 170°C | 180°C |
| LTR/LGR | 180°C | 190°C | 177°C | 187°C |
| P-CARD | 180°C | 195°C | 177°C | 192°C |

CROWNED TEMP DISTRIBUTION

IMAGE FORMING APPARATUS CAPABLE OF ADJUSTING FIXING CONDITIONS

This application is a continuation of application Ser. No. 07/913,386, filed Jul. 15, 1992, now abandoned.

FIELD OF THE INVENTION AND RELATED ART

The present invention relates to an image forming apparatus such as an electrophotographic apparatus, electrostatic recording apparatus, and the like, in particular, an image forming apparatus employing a thermal fixing system.

In an image forming apparatus such as a copying machine, printer, and the like, an unfixed toner image on a recording material is fixed as a permanent image on the recording material.

As a fixing device for these apparatuses, the thermal fixing system is widely used.

One example of this thermal fixing device is shown in FIG. 9.

FIG. 9 shows a fixing roller comprising a core metal *9a* made of aluminum, iron, or the like, and covered with a resin layer *9b* made of PTFE and the like which has a parting property. This fixing roller 9 contains as the heat source a halogen lamp 8 which rotates in a predetermined direction. The exterior surface temperature of this fixing roller 9 is detected by a temperature sensor 7 positioned in contact with this fixing roller 9. The halogen lamp 8 is controlled based on this detection signal, so that the exterior surface temperature of the fixing roller 9 is maintained, over the length thereof, at a constant temperature suitable for fixing purposes.

The fixing roller 9 is paired with a pressing roller 10 compressed thereon. This pressing roller 10 comprises a core metal *10a* which is made of iron, stainless steel, or the like, and is covered with a layer *10b* composed of an elastic material, such as silicon rubber, fluorocarbon rubber, or the like, which has heat resistance as well as excellent parting properties, and is rotated together with the fixing roller 9 in a predetermined direction.

A transfer sheet P carrying a toner time T on its surface facing the fixing roller 9 is passed along an entrance guide 17 and is fed between the fixing roller 9 and pressing roller 10. Then, as the fixing roller 9 and pressing roller 10 rotate, the transfer sheet P is passed through the nip section, being compressed, and meanwhile, the toner image T on the transfer sheet P is heated and pressed by the fixing roller 9 and pressing roller 10 to be fixed as a permanent image on the transfer sheet P. Any portion of the transfer sheet P which adheres to the fixing roller 9 is peeled off by a separating pawl 18.

In a thermal fixing system such as the one described above, the thermal energy necessary for toner fixation varies, depending on the environmental conditions of the thermal fixing roller, such as the temperature. Therefore, it is conceivable to adjust the target temperature of the thermal fixing roller in relation to the printing counts during continuous printing operation.

As for the case in which the temperature sensor is provided off the recording material passage, outside the passage of the smallest size recording material, if a recording material of a smaller size, which does not reach as far as the location of the temperature sensor contact is to be fixed, the heat is robbed from the heat roller surface within the recording material passage, but not from the surface facing the temperature sensor; and therefore, the temperature difference occurs between the heating roller surface region within the sheet passage and the region off the sheet passage.

For the above reason, it is preferable to adjust the target temperature to be higher, based on the print count.

FIG. 10 shows the fluctuation of the fixing roller surface temperature.

In the event the target temperature is adjusted depending on the print count, there are occasions in which the temperature of the surface region facing the sheet passage cannot be maintained constant at the proper fixing temperature because of differences in the environment in which the apparatus is positioned, or the operational conditions.

In particular, this problem tends to occur in apparatuses in which the above mentioned temperature sensor is located off the sheet passage region.

Since the length of time the halogen lamp 8 is kept on varies, depending on whether a print signal is inputted while the fixing device is cool (start-up condition) as is shown in FIG. 10, or the print signal is inputted while it is on standby (temperature is a standby temperature of $T_1$), a temperature difference occurs in the central region of the fixing roller 9. In the latter case, the surface temperature of the central region of the fixing roller 9 becomes lower compared to that in the former case; therefore, a situation sometimes occurs such that the fixing temperature, which will be described later, cannot be reliably maintained, increasing the possibility of causing inferior fixation.

In other words, this inferior fixation is caused by the fact that if the printing signal is inputted once every several minutes or several seconds (intermittent sheet passage) without adjusting the target temperature, the surface temperature in the central region of the fixing roller 9 falls as the number of passed sheets increases, making it impossible to reliably maintain the fixing temperature. The reason why such a condition occurs is that the surface temperature of the fixing roller 9 does not drop as soon as the halogen lamp 8 is turned off, remaining near the target temperature, and if the print signal is inputted in this state, the halogen lamp 8 is barely turned on before the thermostatic state is recovered, failing to increase the surface temperature in the central region of the fixing roller 8. In addition, since the sheets are not continuously passed, the target temperature is not adjusted, and its final result is that the fixing temperature is properly maintained near the temperature sensor 7, but not in the central region of the fixing roller 8 (FIG. 11).

On the other hand, if the target temperature is adjusted using the device for initiating the conveyance of the recording material, with a speculation of the length of time it takes for the recording material to be delivered to the fixing device after the initiation of conveyance, there is not enough time for the surface temperature to reach the satisfactory fixing temperature range, sometimes, and there is too much time, other times.

SUMMARY OF THE INVENTION

The primary object of the present invention is to provide an image forming apparatus capable of maintaining the temperature of the sheet passage region of the thermal fixing device at a proper fixing temperature even if changes occur in the environment in which the apparatus is used, or in its operational conditions.

Another object of the present invention is to provide an image forming apparatus capable of synchronizing the time when the temperature of the fixing heater reaches the fixing temperature to the time when the recording material reaches the fixing heater even if the target temperature of the fixing heater is adjusted.

According to an aspect of the present invention,-there is provided an image forming apparatus which comprises: means for forming an unfixed image on a recording material; fixing means for thermally fixing the unfixed image on the recording material, wherein said fixing means comprises a heater and a temperature detecting element to detect the temperature of the heater; and setting means for setting a fixing condition of said fixing means; wherein said setting means determines the fixing condition based on a number of the image forming operations and an output of said temperature detecting member.

According to another aspect of the present invention, there is provided an image forming apparatus which comprises: means for forming an unfixed image on a recording material; heater for thermally fixing the unfixed image, and of which temperature is maintained at a predetermined fixing temperature; conveying means for conveying the recording material, wherein said conveying means begins to convey the recording material when the temperature of said heater reaches a start temperature which is lower than said fixing temperature; wherein said heater is provided with a first fixing temperature and a second fixing temperature which is higher than the first one, and the start temperature corresponding to the fixing operation using said second fixing temperature is higher than the start temperature corresponding to the fixing operation using said first fixing temperature.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferred embodiments of the present invention will be described.

Figure 12:
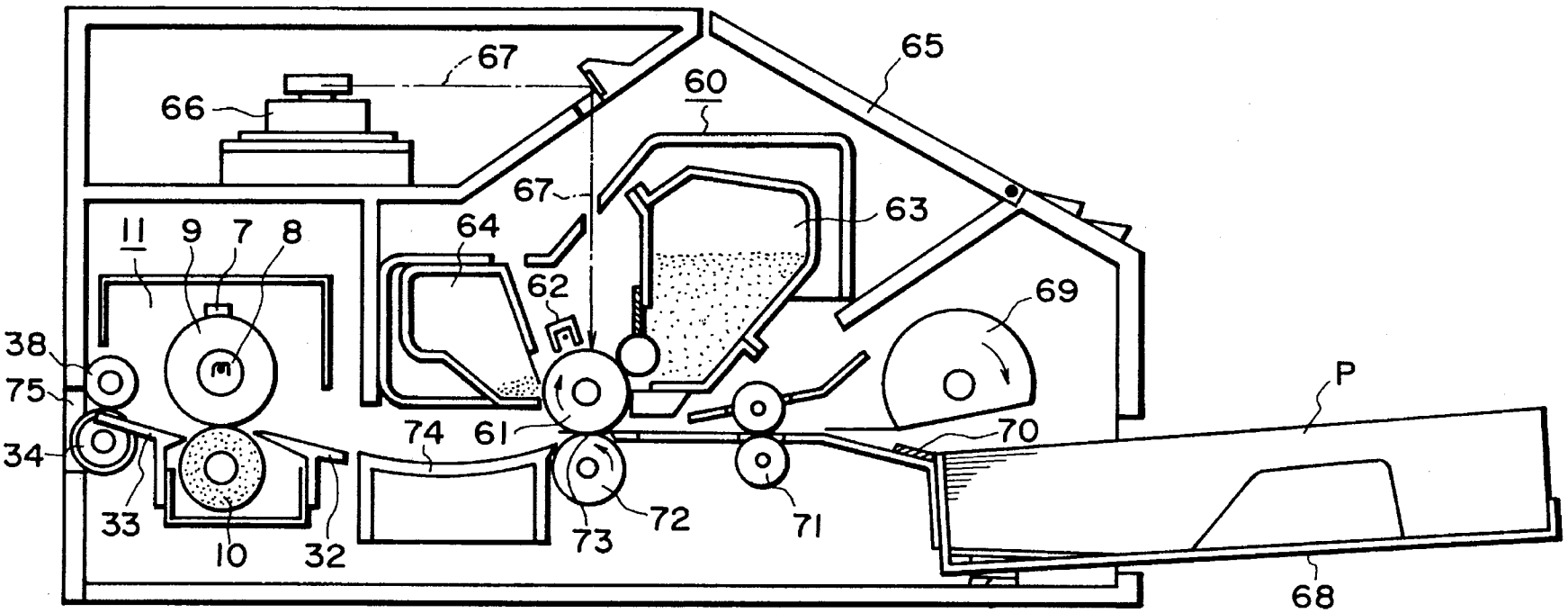
FIG. 12 is a sectional view of an image forming apparatus in accordance with the preferred embodiment of the present invention.

FIG. 12 is a sectional view of an image forming apparatus in accordance with the preferred embodiment of the present invention. This example of an image forming apparatus is a laser beam printer employing a transfer type electrophotographic process.

Reference numeral 60 designates a process cartridge containing four processing means: a rotatable drum type electrophotographic photosensitive member 61 (hereinafter, called drum), a charger 62, a developer 63, and a cleaning device 64. This process cartridge can be loaded at or unloaded from a predetermined location within the apparatus, through an opening to be provided by releasing the cover section 65.

An image formation start signal initiates the rotation of the drum 61 in the clockwise direction indicated by an arrow; the surface of the rotating drum 61 is uniformly charged to have a predetermined polarity and potential by the charger 62; the charged drum surface is exposed to a scanning laser beam 67 which is modulated by the time series electric digital picture element signal of the intended image information, whereby an electrostatic latent image, which corresponds to the intended image information, is sequentially formed on the drum 61 surface. Next, this latent image is visualized as a toner image by the developer 63.

On the other hand, the recording sheets P in a feed cassette 68 are separated and fed one by one by cooperation between a feed roller 69 and a separating pad 70.

The recording material sheet P fed by the feed roller 69 remains on standby, with its tip held between a pair of register rollers 71, which is also a conveying means. This recording material sheet P on standby begins to be conveyed, in synchronism with the rotation of the drum 61, to a nip section 73, which is a compressing section formed between the drum 61 and a transfer roller 72 which faces the drum 61 and is pressed thereon.

In this nip section 73, the unfixed toner image carried on the drum surface is sequentially transferred onto the surface of the recording material sheet P.

The recording material sheet P which has been passed through the transfer section 73 is separated from the drum 61 surface by the curvature of the drum; is introduced into the fixing device 11 by the guide 74, where the unfixed toner image is thermally fixed; and then, is discharged from the exit 75 by a pair of discharge rollers 34 and 38.

After the recording material sheet P has been passed through the transfer section 73 and is separated from the drum 61 surface, the drum 61 surface is cleaned by the cleaning device 64 to remove adhering contaminants such as transfer toner residue, and is repeatedly used for image formation.

Figure 1:
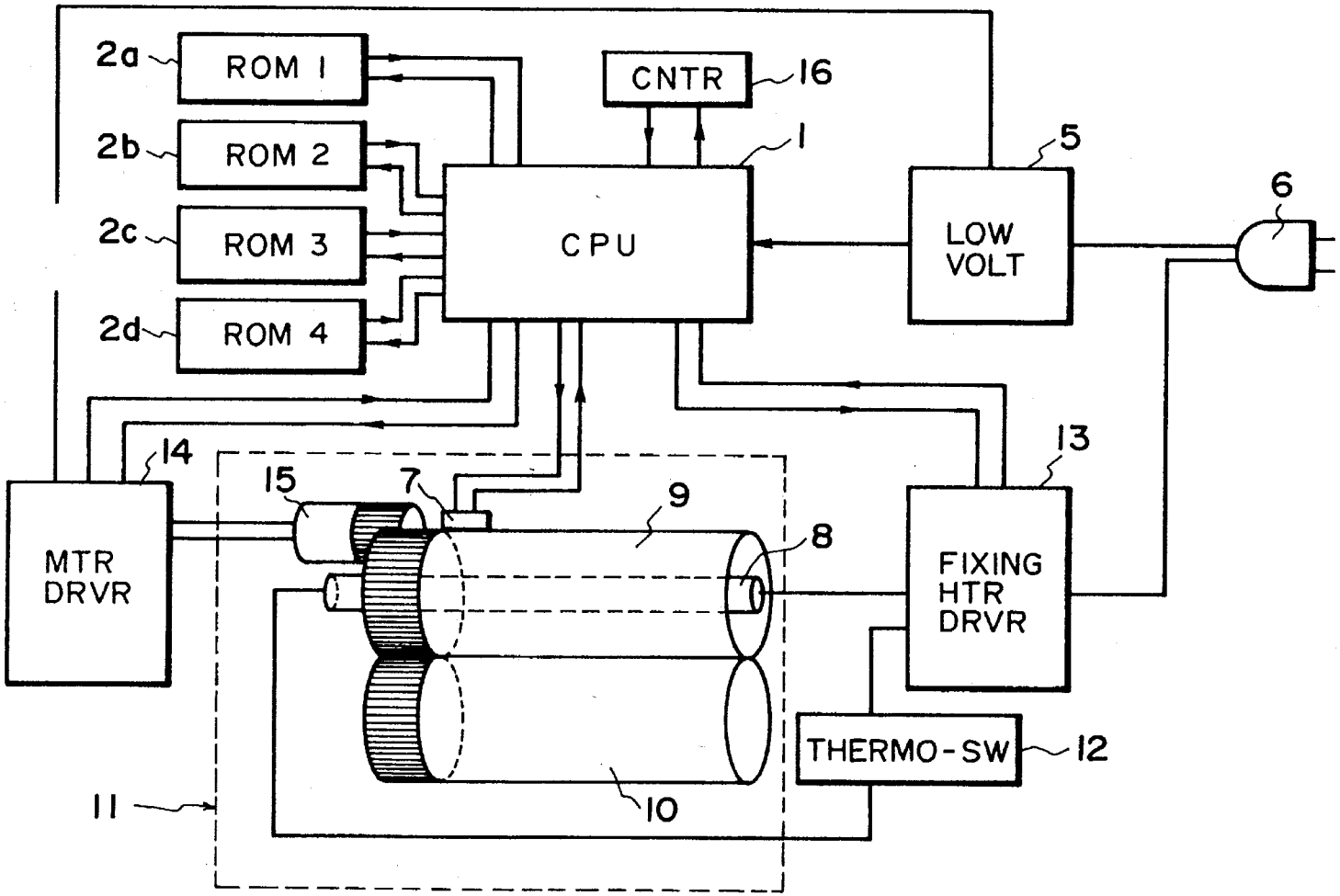
FIG. 1 is a schematic diagram of a preferred embodiment of the present invention.

FIG. 1 is a schematic diagram of the present invention. In this figure, the components such as the image forming section, feed section, conveyer section, and driving section are omitted to show the fixing section, which displays the most distinctive characteristics of the present invention.

Figure 8:
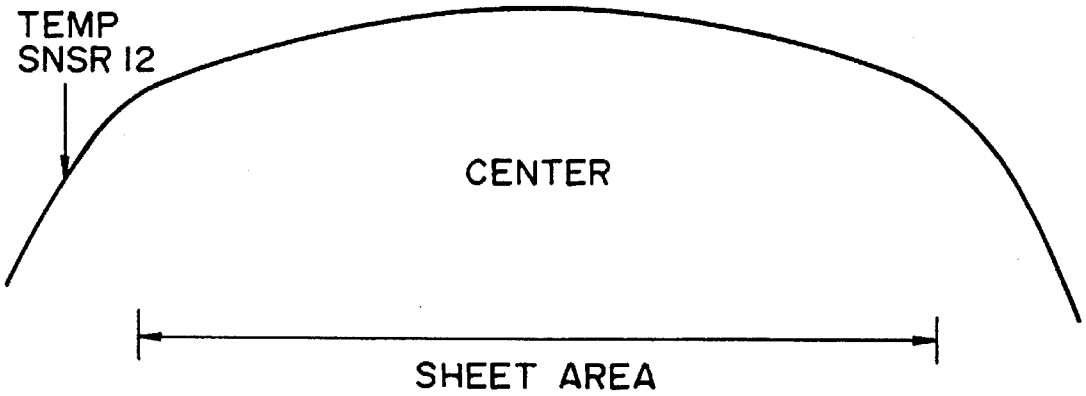
FIG. 8 is a diagram showing the heat distribution of the heater employed in the preferred embodiment of the present invention.
Figure 9:
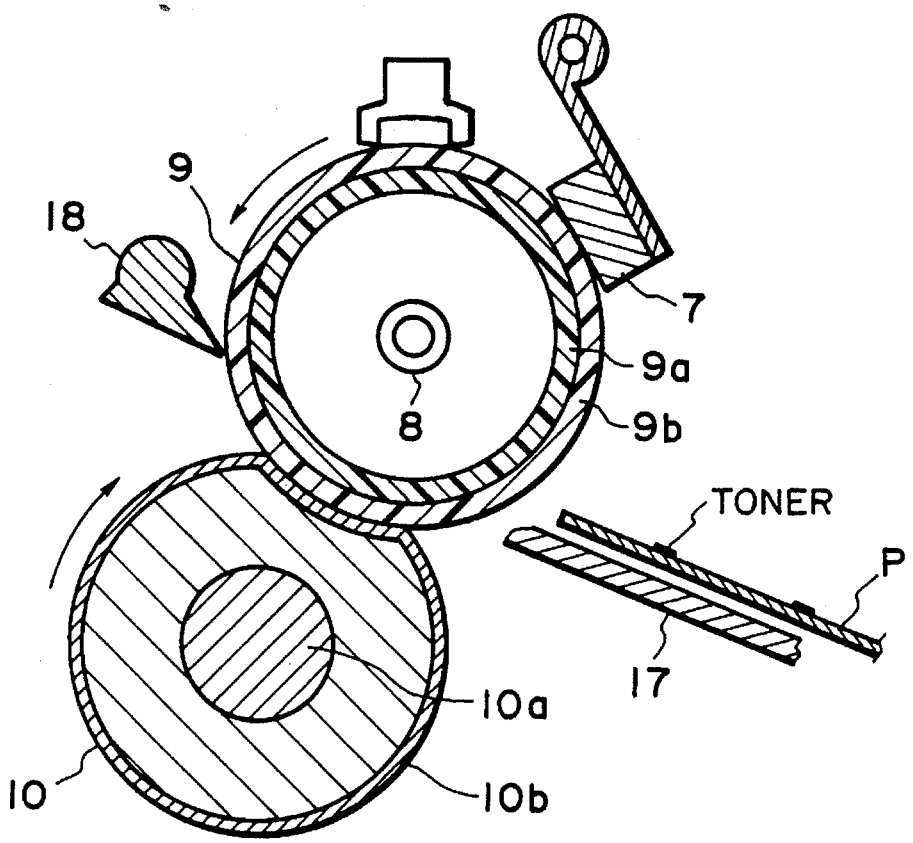
FIG. 9 is a sectional view of the prior fixing device.

The fixing device 11 comprises the fixing roller 9 and the pressing roller 10 which is pressed upon this fixing roller 9 and is rotated thereby, and it allows the passage of a maximum sheet size of B4. There is provided within the fixing roller 9, a heater 8 (halogen heater with specifications of 100 V and 665 W, in the case of the device in accordance with this embodiment) having a crown type heat distribution characteristic, in other words, the characteristic that the heat distribution is higher in the central region than in the end region, as is shown in FIG. 8. Also, connected to this heater 8 are a fixing heater driving circuit 13 which receives a signal from CPU 1 (central processing unit), which will be described later, and confines the amount of heat generation of this heater 8 within a predetermined range based on this signal; and a thermo-switch 12 which cuts off the current when the temperature of the fixing roller rises abnormally due to the failure of the driving circuit 13. Also, a main motor 15 is provided at the left end side of the fixing roller 9, which rotates this fixing roller 9 in the predetermined direction through gears and such. To this main motor 15, a motor drive circuit 14 is connected, which receives a signal from the CPU 1, which will be described later, and rotates the motor 15 based on this signal.

Next, a control means will be described, which selects the fixing conditions for the fixing device in accordance with this embodiment.

The CPU 1 (central processing unit), which is the central system of the control means, is connected to a low voltage power source 5, which enables the use of commercial power supplied from an outlet 6 by lowering its voltage.

Further, the CPU 1 is connected to ROM 2, ROM 3 and ROM 4, which are the storage means which contain the thermal fixation temperature control sequences for the fixing section; CPU 1 is connected to ROM 1, where the data necessary for carrying out the sequence contained in ROM 2, ROM 3 or ROM 4 are stored; and CPU 1 is connected to the temperature sensor 7 (thermistor) which is positioned in direct contact with the fixing roller on its surface region off the sheet passage, and detects the surface temperature of the fixing roller.

In this embodiment, the thermistor 7 is positioned in contact with the fixing roller on its surface region off the sheet passage for the largest size recording material, so that the location of the thermistor 7 contact remains off the sheet passage regardless of the recording material size.

Figure 2:
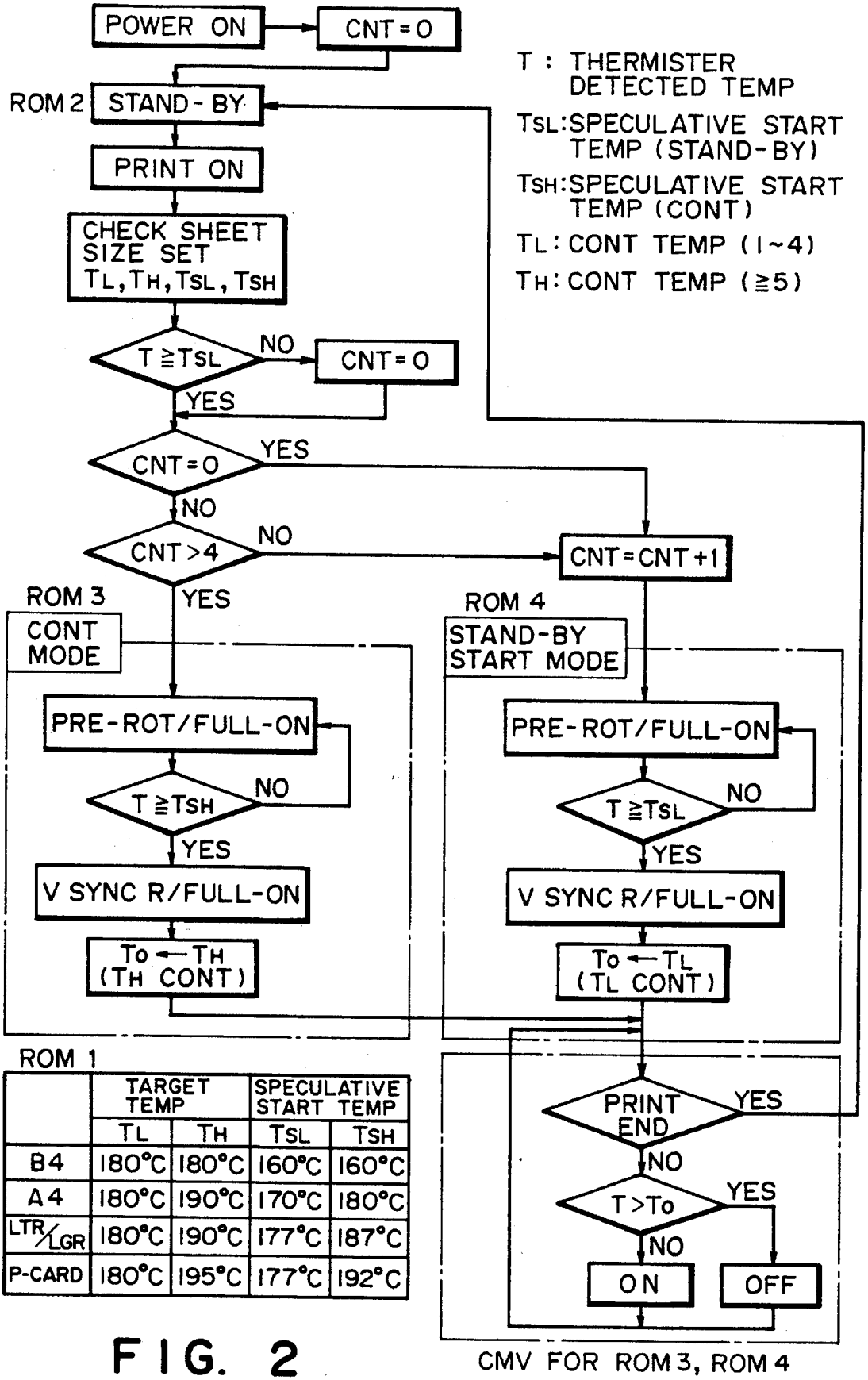
FIG. 2 is a flow chart for the preferred embodiment of the present invention.

FIG. 2 is a flow chart showing the operation of this embodiment.

ROM 2 stores a temperature control program for the fixing section. This program makes the fixing roller surface temperature quickly reach the first target temperature (standby temperature) established as a preheating temperature, which is lower than the fixing temperature, and then maintains the standby temperature. ROM 3 and ROM 4 also store temperature control programs for the fixing section. These programs make the fixing roller surface temperature quickly reach the second target temperature, which is the fixing temperature, when an image forming operation command (print signal) is received.

When a power switch of the apparatus main assembly is turned on, and 100 V of power is supplied from outlet 6 to the low voltage power source 5, CPU 1 initiates its operation. First, it reads the information stored in ROM 1, ROM 2, ROM 3 and ROM 4, and resets a counter 16 to zero. Next, it executes the sequence stored in ROM 2, putting the fixing device 11 on standby. When this standby state is realized, and a print signal is inputted from an external apparatus such as a computer, the CPU 1 checks the size of the sheets placed within the apparatus main assembly; selects the data necessary for controlling the fixing temperature ($T_L$: target temperature L (corresponds to counter values of one to four), $T_H$: target temperature H (corresponds to counter values of more than five), $T_{SL}$: speculative temperature No. 1, and $T_{SH}$: speculative temperature No. 2) which correspond to the sheet sizes, based on the data input from ROM 1; and selects one of the sequences read from ROM 3 and ROM 4.

These speculative temperatures $T_{SL}$ and $T_{SH}$ are the temperatures which are higher than the standby temperature but lower than the target temperatures $T_L$ and $T_H$ for the fixing operation, and when these temperatures are reached, the recording material begins to be conveyed from the unshown feed cassette, which stores the recording material, to the image forming section.

The surface temperature of the fixing roller reaches the target temperature by the time the recording material arrives at the fixing device after the recording material begins to be conveyed.

Next, the CPU 1 compares the temperature T detected by the thermistor 7 to the temperature $T_{SL}$ read in advance. If $T<T_{SL}$, it first resets the counter to zero, as is shown by the flow chart in FIG. 2, and follows the sequence stored in ROM 4, fully turning on the heater 8.

Then, as the temperature of the fixing roller rises and the temperature T detected by thermistor 7 comes to satisfy $T \geqq T_{SL}$, the CPU 8 turns the heater 8 half-on (for example, the ON/OFF duty of the heater is set at 4/6), and initiates the image forming process and sheet conveyance.

Figure 3:
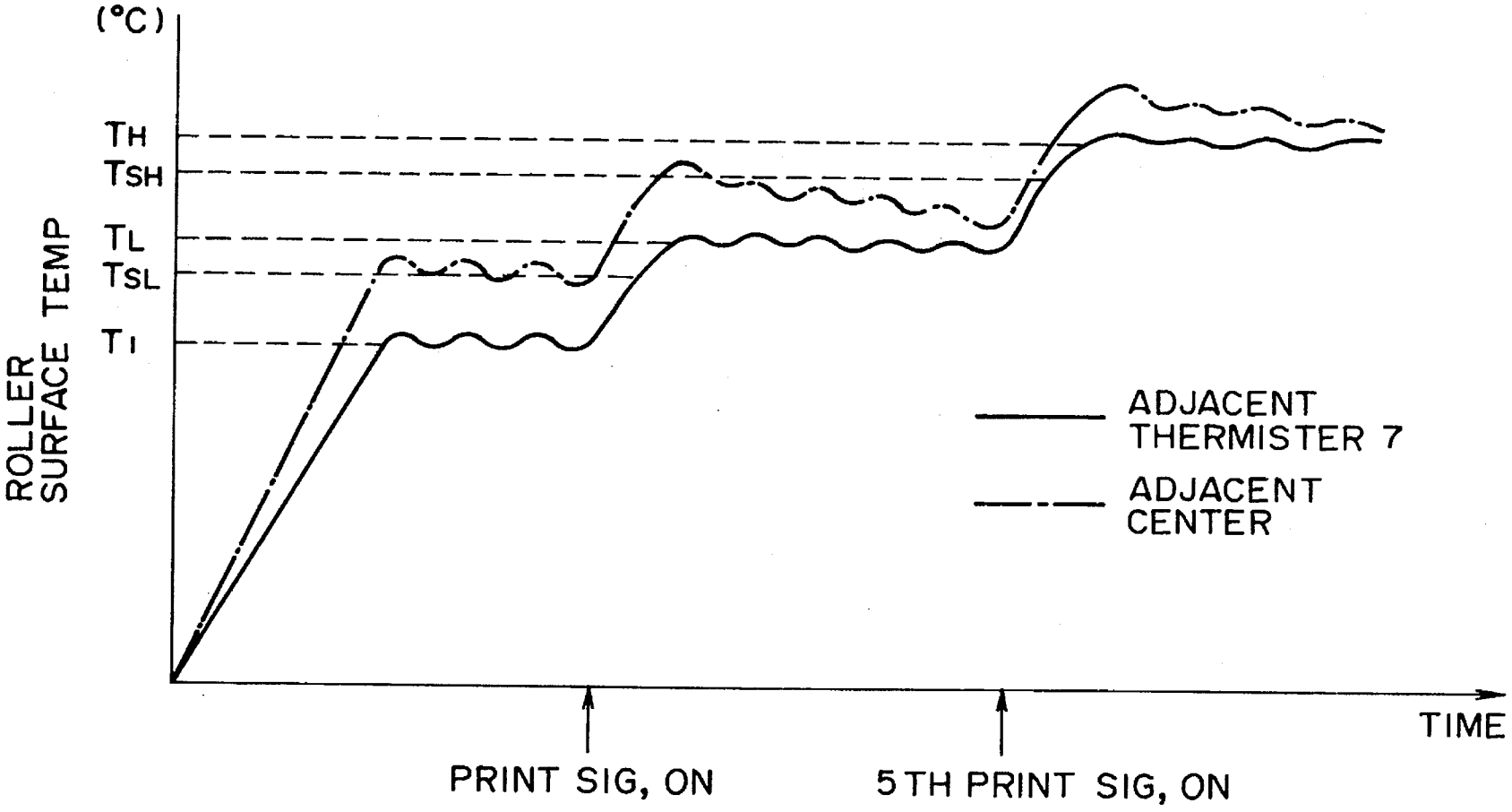
FIG. 3 is a graph showing the surface temperature fluctuation of the fixing roller in accordance with the preferred embodiment of the present invention.

Next, the CPU 1 selects $T_L$ as the fixing temperature (second target temperature) and executes the temperature control so that the surface temperature of the fixing roller 9 becomes $T_L$. When the print signal is continuously sent in, the temperature T detected by the thermistor 7 always satisfies $T \geqq T_{SL}$; therefore, the counter 16 is not reset. Until the value in the counter reaches 5, the sequence stored in ROM 4 is followed to raise the temperature from the standby temperature, and when the counter 16 exceeds 5, the sequence stored in ROM 3 is selected to control the amount of heat generated by the heater 8 to maintain the next fixing temperature ($T_H$) which is higher than $T_L$, as is shown in FIG. 2. FIG. 3 shows the surface temperature fluctuation of the fixing roller 9 for the case in which continuous sheet passage operation is started when this apparatus has not been used.

Figure 10:
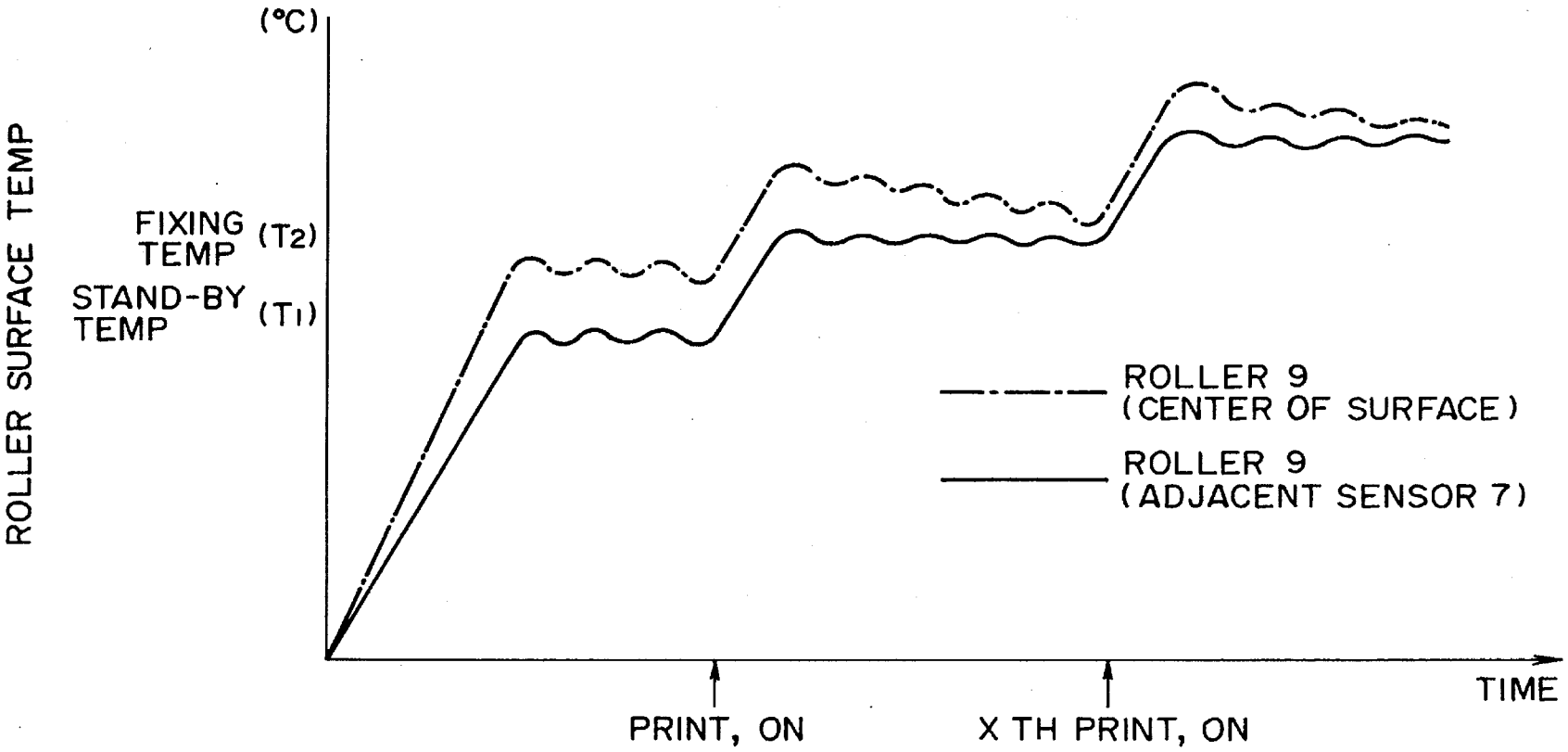
FIG. 10 is a graph showing the surface temperature fluctuation of the fixing roller.
Figure 11:
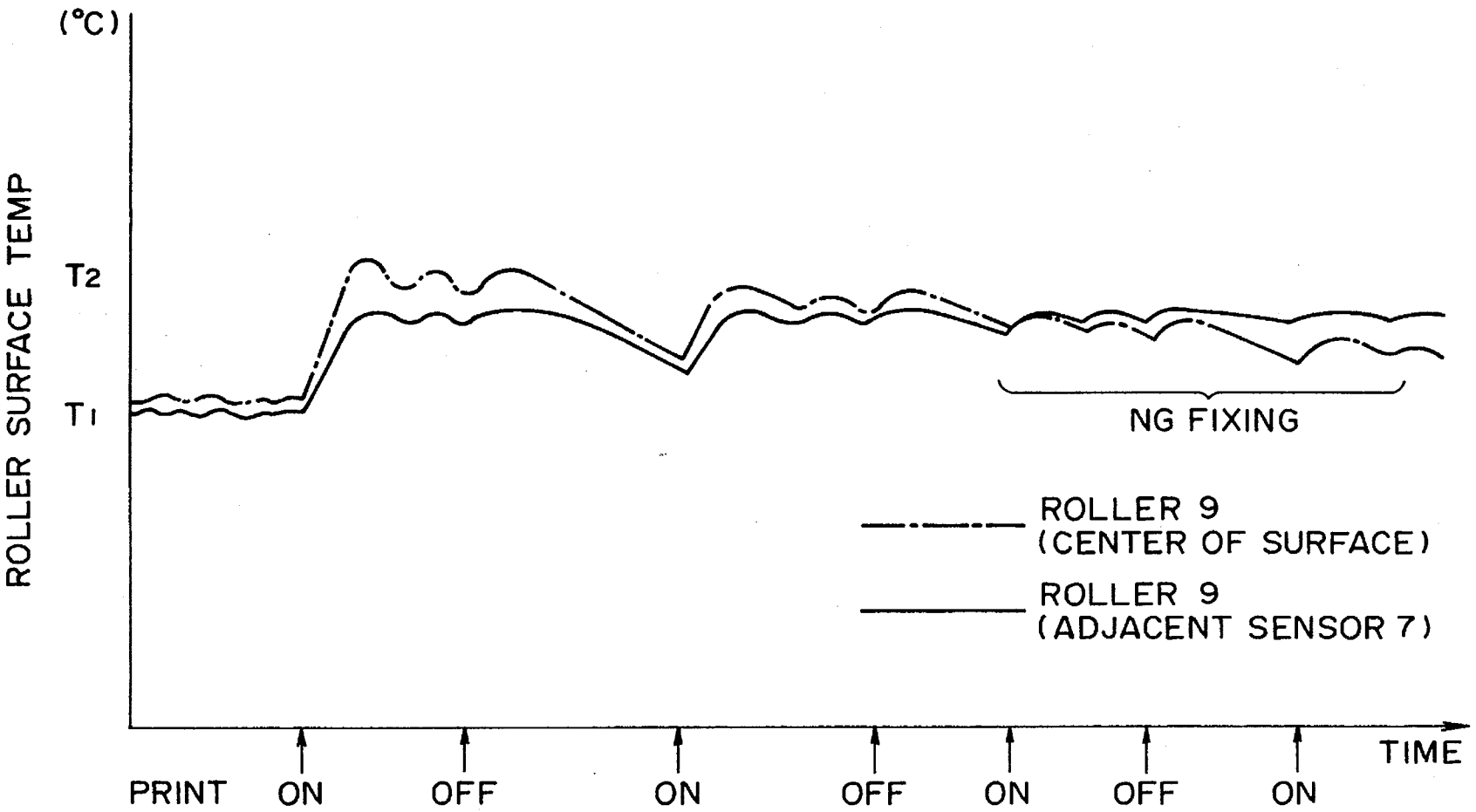
FIG. 11 is a graph showing the surface temperature fluctuation of the fixing roller.

In this case, the temperature fluctuation displays the same pattern as the example in FIG. 10.

As for the case in which the print signal is sent in with random intervals, the counter is not reset if the temperature condition satisfies $T \geqq T_{SL}$, but is reset if the temperature of the fixing roller becomes sufficiently low to satisfy the temperature condition of $T<T_{SL}$.

When it comes to print end, the heater 8 is turned off, and the CPU 1 executes the control to put the fixing device on standby. If the print signal is sent in again at this point, the CPU 1 reads the temperature T detected by the thermistor 7 to compare it to $T_{SL}$. If the temperature satisfies $T>T_{SL}$, the CPU 1 resets the counter 16 to zero and selects the sequence stored in ROM 4. The succeeding steps hereafter is as were described before.

Figure 4:
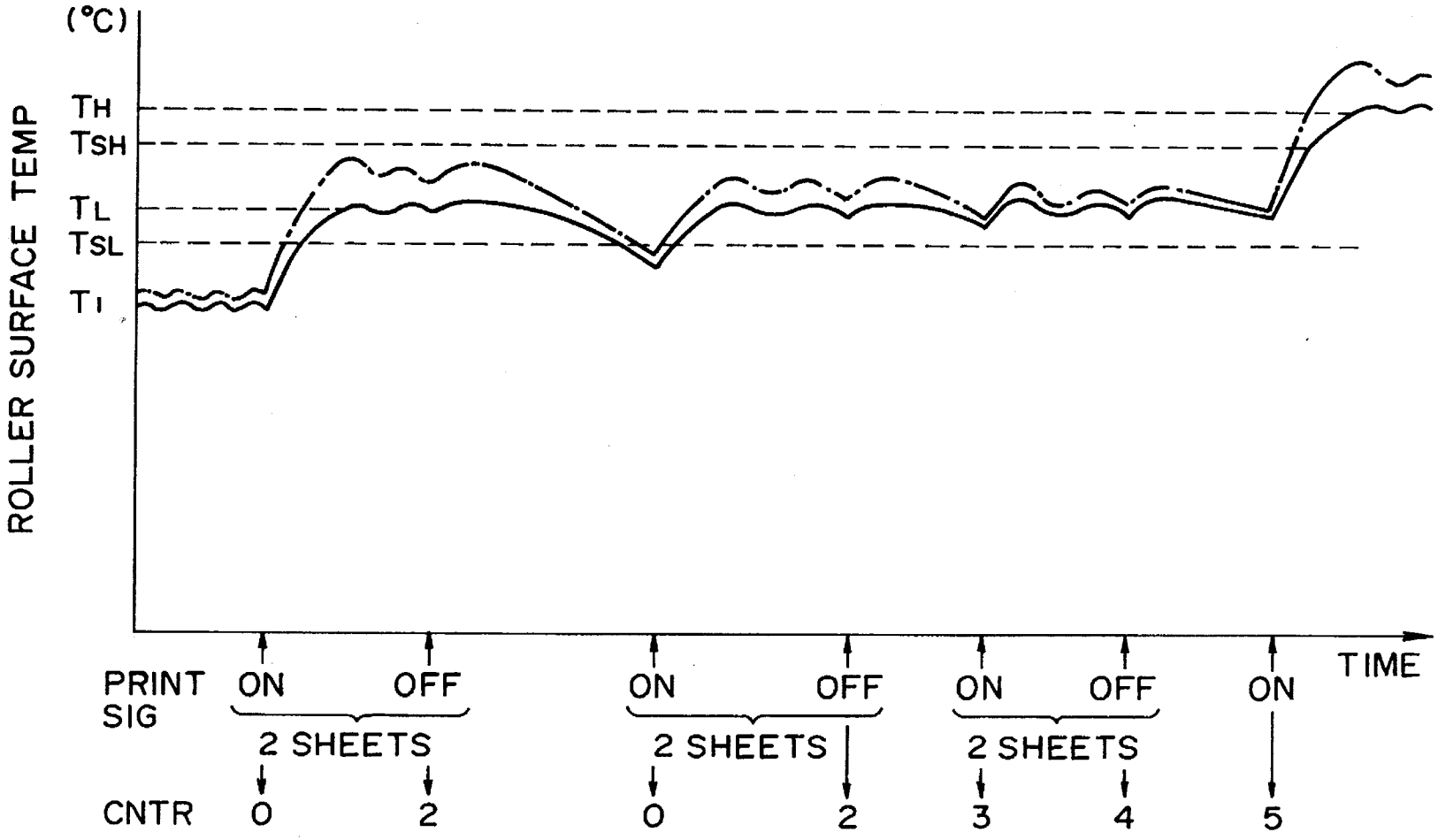
FIG. 4 is a graph showing the surface temperature fluctuation of the fixing roller in accordance with the preferred embodiment of the present invention.

If the value in the counter is four or less, the CPU selects the sequence in ROM 4, and if it is five or more, the CPU selects the sequence in ROM 3. The succeeding controls are executed as was described before. FIG. 4 shows the surface temperature fluctuation of the fixing roller 9 for the case of intermittent sheet passage (including the standby state)

described so far.

In this embodiment, since whether the counter is incremented or reset is determined based on the fixing roller temperature at the time of the print signal entry, the target temperature is adjusted even during the state of intermittent sheet passage; therefore, the surface temperature in the central region of the fixing roller 9 can be reliably maintained higher than the fixing temperature as it is during the continuous sheet passage state, effecting excellent fixing property.

In other words, if the present invention is employed, the optimum sequence for controlling the fixing device is selected based on the temperature detected by the thermistor 7; therefore, it becomes always possible to secure excellent fixing property regardless of the sheet size. The present invention is specially effective for the case in which there is a large size difference between the largest sheet size and the smallest one (for example, a combination of the largest size sheet: A3 or B4, and the smallest sheet size: A6). Furthermore, if the present invention is employed, the temperature sensor can be positioned in direct contact with the fixing roller surface outside the sheet passage region for the minimum size sheet; therefore, it is possible to avoid influence of the damage in the fixing region of the fixing roller surface, for the smallest size sheet.

In addition, in this embodiment, the speculative start temperature at which the recording material begins to be conveyed is adjusted depending on the adjustment of the target temperature.

In other words, the control is executed in such a manner that the higher the target temperature is adjusted to be, the higher the speculative start temperature is adjusted to be; the lower the target temperature is adjusted to be, the lower the speculative start temperature is adjusted to be; and in particular, the difference between the target temperature and the speculative start temperature is constant.

Thus, even if the target temperature is adjusted, the fixing temperature can be quickly and reliably reached before the recording material is enters into the nip.

Second Embodiment

Figure 5:
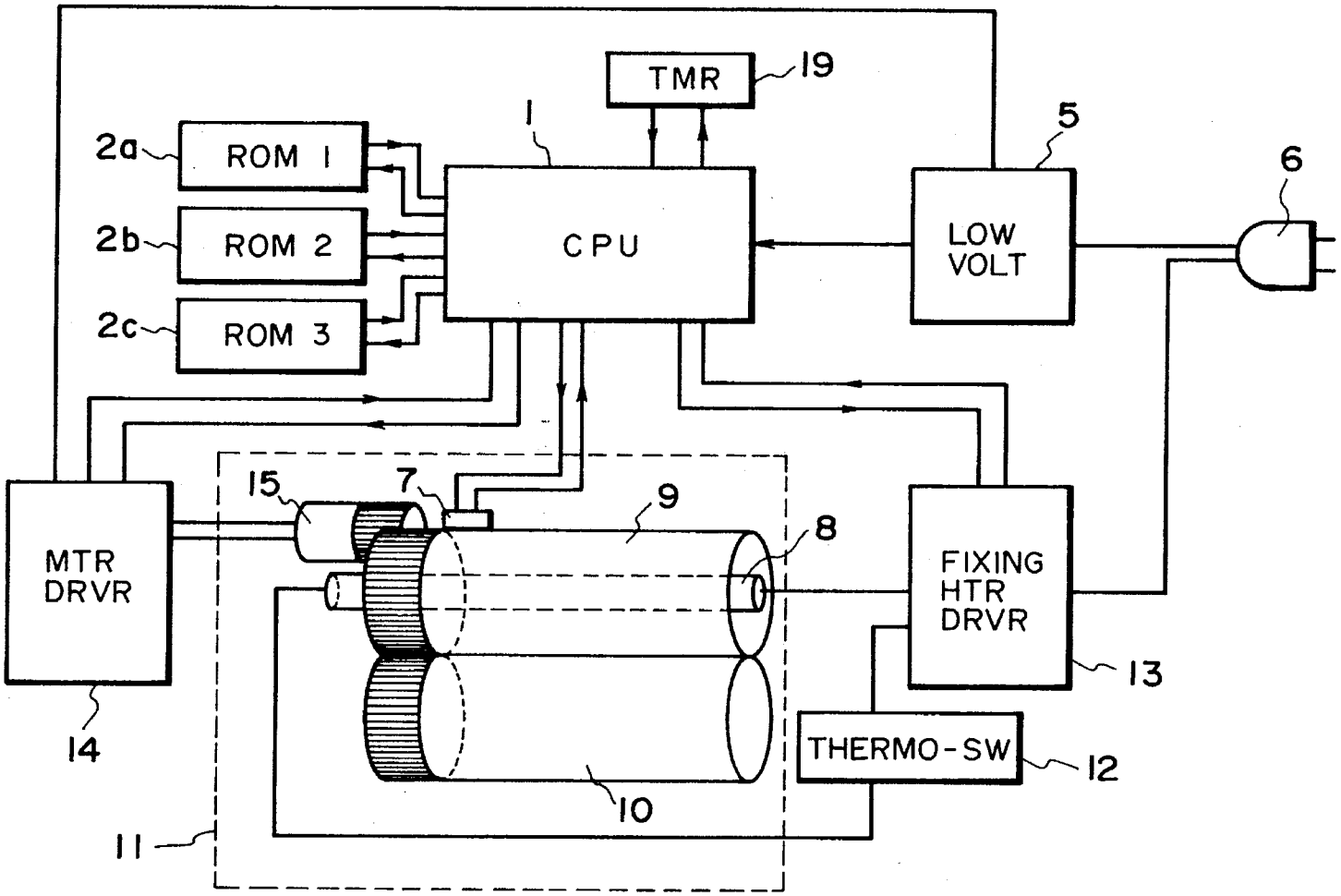
FIG. 5 is a schematic diagram of a second embodiment of the present invention.

The second embodiment of the present invention is shown in FIG. 5.

In the embodiment shown in FIG. 5, not only the temperature detected by the thermistor 7, but also, the voltage fluctuation of the commercial power source, the power consumption variance of the heater 8 brought forth by the component lot variance, and further, the environment where the apparatus main assembly is placed are taken into consideration to select the optimum method for controlling the fixing device in the state it is in.

Hereinafter, the second embodiment will be described. Since the second embodiment basically has the same structure as the first embodiment, the identical sections are not going to be described. In the second embodiment, the counter 16 found in the first embodiment is eliminated, and a timer 19 is provided instead. The ROM connected to CPU 1 stores the fixing device control sequences having the contents shown in FIG. 6. When the power source of the apparatus main assembly is turned on, the CPU 1 resets timer 19, and at the same time, reads the fixing device control sequences from ROM 1, ROM 2 and ROM 3, and executes the contents of ROM 1. The CPU 1 continues to check the value in the timer 19, and reads the output of thermistor 7 when the value in timer 19 reaches a given predetermined value x. At this time, if the temperature T detected by thermistor 7 is smaller than a predetermined value $T_a$, CPU 1 determines that the operation of the apparatus main assembly is in the state in which the input voltage is low, the power consumption of the heater 8 is low, or the apparatus main assembly is positioned in the low temperature environment, and executes the sequence read from the ROM 3. In the ROM 3 sequence, the heater 8 is fully turned on to generate the maximum amount of heat.

If T is higher than $T_a$, the CPU 1 determines that the input power to the apparatus main assembly is normal (in other words, the power consumption of the heater 8 is sufficient), or that the apparatus main assembly is positioned in a normal environment (room temperature ≧20° C.), and executes the sequence from ROM 2. In the ROM 2 sequence, the heater 8 is controlled to be 40% ON and 60% OFF to suppress overshooting.

Figure 6:
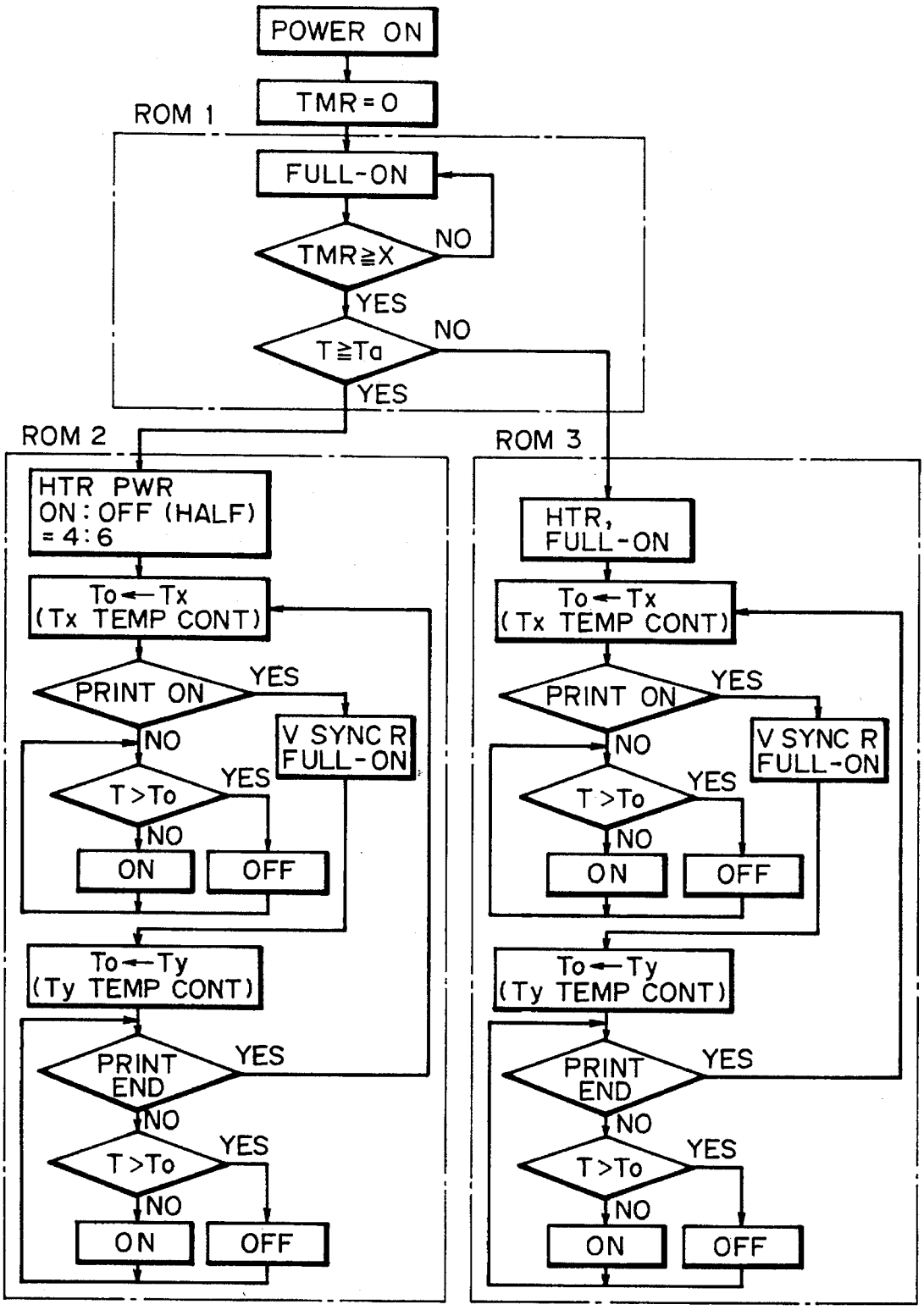
FIG. 6 is a flow chart for the second embodiment of the present invention.
Figure 7:
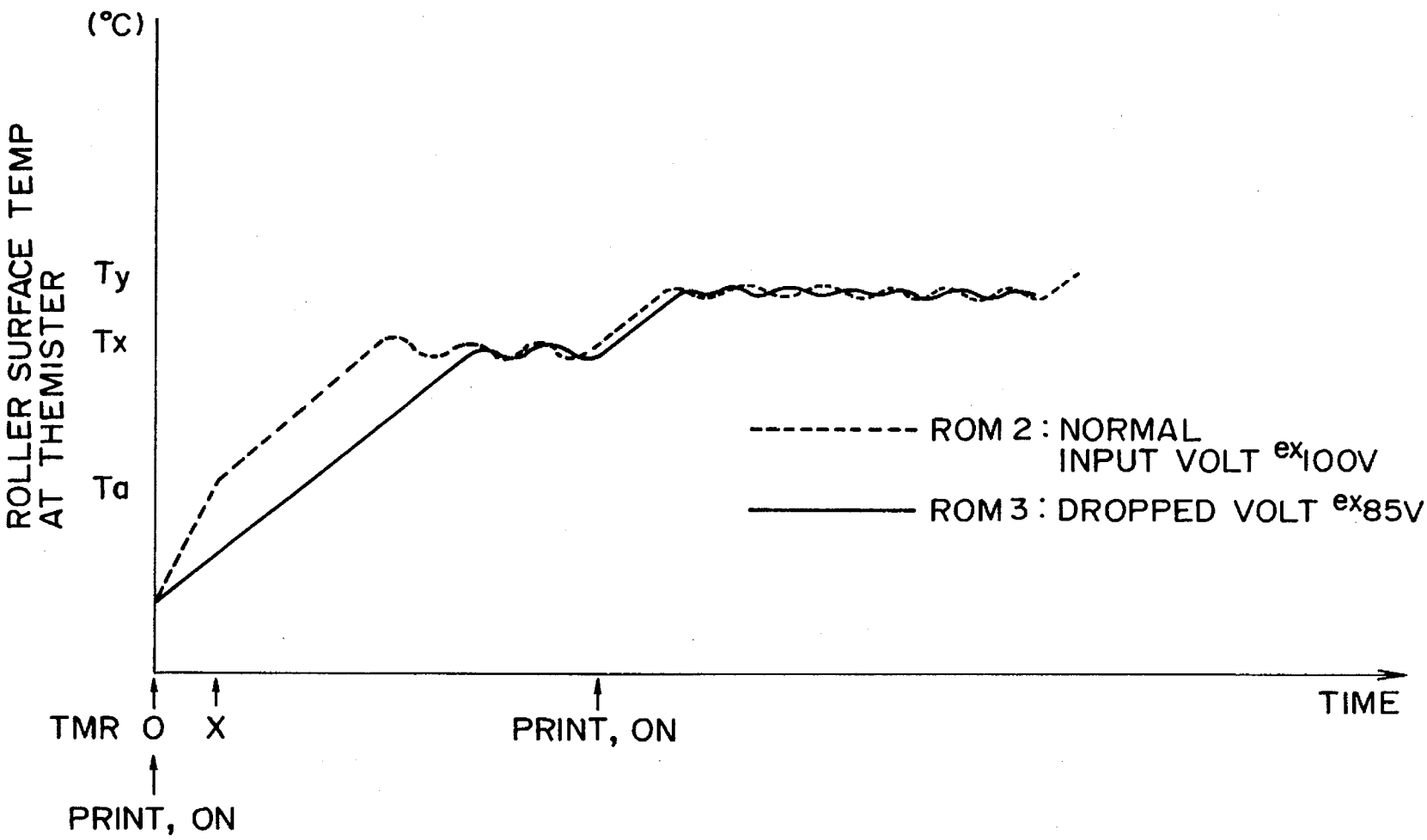
FIG. 7 is a graph showing the surface temperature fluctuation of the fixing roller in accordance with the second embodiment of the present invention.

Below, the fixing device 11 is controlled following the flow chart shown in FIG. 6. The surface temperature fluctuation of the fixing roller at this time is shown in FIG. 7.

If $T_a$ is set up as an amount of change ($T_a=T_1-To$; $T_1$ is the temperature when the value in the timer=x, and To is the temperature when the value in the time=0) and is compared to the temperature T which is also calculated as an amount of changes detected by the thermistor 7, it is possible to handle a case such that the power source of the apparatus main assembly is reset in the standby state. According to the second embodiment of the present invention, it is possible to always use the optimum control method to control the fixing device, even if the power consumption of the heater fluctuates, due to the fluctuation of the input voltage to the apparatus main assembly, and whatever kind of environment the apparatus main assembly is placed in.

In the above, the embodiments of the present invention have been described referring to a heating roller type fixing system, but they can be applied to other types of thermal fixing devices.

According to the present invention described in the above, it is possible to provide stable fixing properties regardless of the environmental and operational conditions.

Furthermore, the fixing temperature can be reached, reliably and in a short time, before the recording material is entered into the fixing device, even if the target temperature is adjusted.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

means for forming an unfixed image on a recording material;

fixing means for thermally fixing the unfixed image on the recording material, wherein said fixing means comprises a heater and a temperature detecting element to detect the temperature of the heater; and setting means for setting a fixing condition of said fixing means, wherein said setting means comprises a counter for counting the number of image forming operations and reset means for resetting the count value in the counter, and wherein said setting means determines the fixing condition based on the counted number of image forming operations and an output of said temperature detecting element.

2. An image forming apparatus according to claim 1, wherein said setting means predetermines a fixing temperature as a fixing condition and controls power supply to said heater so that the temperature detected by said temperature detecting element of said fixing means is maintained at the predetermined temperature.

3. An image forming apparatus according to claim 1, wherein said heater is a heating roller heated by a heat source.

4. An image forming apparatus according to claim 1, wherein said setting means determines the fixing condition based on the counted number of image forming operations during continuous image formation.

5. An image forming apparatus according to claim 1, wherein said reset means resets the count in said counter if the temperature detected by said temperature detecting element falls below a predetermined temperature.

6. An image forming apparatus according to claim 1, wherein said fixing means further comprises a back-up member cooperable with said heater to form a nip, and the unfixed image is fixed while the recording material is conveyed through said nip.

7. An image forming apparatus according to claim 6, wherein said temperature detecting element is provided in direct contact with said heater on its surface region off a recording material passage region.

8. An image forming apparatus according to claim 7, wherein said setting means sets up the fixing conditions so as to improve the fixing property when the number increases, and also, when the recording material size is small.

9. An image forming apparatus, comprising:

means for forming an unfixed image on a recording material;

a heater for thermally fixing the unfixed image, and of which temperature is maintained at a predetermined fixing temperature;

conveying means for conveying the recording material;

conveyance start control means for controlling conveyance start timing of said conveying means, said conveyance start control means starting operation of said conveying means when the temperature of said heating means reaches a predetermined temperature lower than a fixing temperature;

fixing temperature control means for selecting the fixing temperature;

wherein said conveyance start control means starts a conveyance operation of said conveying means at a first conveyance starting temperature when said fixing temperature control means selects a first fixing temperature, and wherein said conveyance start control means starts a conveyance operation of said conveying means at a second conveyance starting temperature when said fixing temperature control means selects a second fixing temperature which is higher than the first fixing temperature.

10. An image forming apparatus according to claim 9, wherein said heater reaches said fixing temperature before said recording material arrives at said heater.

11. An image forming apparatus according to claim 9, wherein said heater is a heating roller heated by a heat source.

12. An image forming apparatus according to claim 9, wherein, while the apparatus is put on standby, the temperature of said heater is maintained at a standby temperature which is lower than the first conveyance start temperature.

13. An image forming apparatus comprising:

image forming means for forming an unfixed image on a recording material, said image forming means starting an image forming operation upon input of an image formation signal;

a heating member;

a back-up member cooperable with said heating member to form a nip, wherein the unfixed image is fixed in a fixing operation while the recording material is conveyed through said nip;

a temperature detecting element for detecting a temperature of said heating member, said temperature detecting element being disposed outside a recording material passage region and detecting a temperature upon input of the image formation signal; and setting means for setting a fixing condition during the fixing operation;

wherein said setting means determines the fixing condition to be set based on the number of image forming operations and on the detected temperature of said temperature detecting element upon input of the image formation signal.

14. An apparatus according to claim 13, wherein said setting means predetermines a fixing temperature as a fixing condition and controls power supply to said heating member so that the temperature detected by said temperature detecting element of said fixing means is maintained at the predetermined temperature.

15. An apparatus according to claim 13, wherein said heating member is a heating roller heated by a heating source.

16. An apparatus according to claim 13, wherein said setting means determines the fixing condition based on the number of image forming operations during continuous image formation.

17. An apparatus according to claim 13, wherein said setting means sets up the fixing conditions so as to improve the fixing property when the number of image forming operations increases, and also, when the recording material size is small.

* * * * *

UNITED STATES PATENT AND TRADEMARK OFFICE

CERTIFICATE OF CORRECTION

PATENT NO. : 5,481,346
DATED : January 2, 1996
INVENTOR(S) : YUKIHIRO OHZEKI, ET AL.

It is certified that error appears in the above-indentified patent and that said Letters Patent is hereby corrected as shown below:

Column 3,
line 7, "invention,-there" should read --invention, there--;
line 45, "flow chart" should read --flowchart--; and
line 56, "flow chart" should read --flowchart--.
Column 6,
line 27, "CPU 8" should read --CPU 1--.
Column 7,
line 40, "is" should be deleted.
Column 8,
line 19, "flow chart" should read --flowchart--.
Column 9,
line 46, "temperature;" should read --temperature; and--.

Signed and Sealed this

Fourteenth Day of May, 1996

Bruce Lehman

*Attest:*

BRUCE LEHMAN

*Attesting Officer*

*Commissioner of Patents and Trademarks*